United States Patent [19]

Krob

[11] 4,453,731

[45] Jun. 12, 1984

[54] SKI BRAKE

[75] Inventor: Erwin Krob, Vienna, Austria

[73] Assignee: TMC Corporation, Baar, Switzerland

[21] Appl. No.: 362,174

[22] Filed: Mar. 25, 1982

[30] Foreign Application Priority Data

| | | | |
|---|---|---|---|
| Mar. 27, 1981 | [AT] | Austria | 1459/81 |
| Apr. 16, 1981 | [AT] | Austria | 1760/81 |
| Apr. 16, 1981 | [AT] | Austria | 1762/81 |

[51] Int. Cl.[3] ..... A63C 7/10

[52] U.S. Cl. ..... 280/605

[58] Field of Search ..... 180/605, 604, 12 AB; 188/5

[56] References Cited

U.S. PATENT DOCUMENTS

| | | | |
|---|---|---|---|
| 4,278,268 | 7/1981 | Szasz | 280/605 |
| 4,333,667 | 6/1982 | Leichtfried | 280/605 |
| 4,371,187 | 2/1983 | Svoboda | 280/605 |
| 4,375,895 | 3/1983 | Szasz | 280/605 |

FOREIGN PATENT DOCUMENTS

| | | | |
|---|---|---|---|
| 8000391 | 7/1980 | Netherlands | 280/605 |

*Primary Examiner*—Joseph F. Peters, Jr.
*Assistant Examiner*—Joseph McCarthy
*Attorney, Agent, or Firm*—Flynn, Thiel, Boutell & Tanis

[57] ABSTRACT

A ski brake has a base plate and has a stepping plate which is hinged to the base plate by means of a transverse axle and is biased by an erecting spring, in which stepping plate or on which stepping plate are pivotally supported two braking mandrels by their support sections. Pivotal movement of each braking mandrel occurs either by means of a coarse thread provided on its support section which operatively engages an internal thread of a structural part fixed on the stepping plate or movable relative to the stepping plate, or by means of a helical slot which guides the transversely extending section of the braking mandrel.

14 Claims, 30 Drawing Figures

SKI BRAKE

FIELD OF THE INVENTION

This invention relates to a ski brake which includes a base plate which can be secured on a ski and a stepping plate which is pivotally supported on the base plate by means of a transverse axle and is biased by an erecting spring, in or on which stepping plate, by means of at least two bearings or bearing blocks, are pivotally supported two braking mandrels by means of their support sections which are remote from the braking plates and are arranged parallel to same.

BACKGROUND OF THE INVENTION

Conventional ski brakes of this type, for example that disclosed in German OS No. 30 40 920, are somewhat complicated in their design, in as far as four resilient elements are needed for effecting swivelling of the two braking mandrels about their axes in both rotational directions. Furthermore, the swivelling is effected by extensions on the sections of the two braking mandrels which are supported in the stepping plate, which extensions engage leaf springs or springy flaps and, during a swinging down of the stepping plate, are swung against same and in this manner rotate the mentioned sections through a pregiven angle. However, this had the disadvantage that, in the case of wear of the two extensions or the flaps, the angle of movement of the braking mandrels changed so that the braking plates, after long use, at times would no longer lie above the upper side of the ski and inwardly of the two side surfaces of the ski in the retracted position, which could result in a hindrance to the skier.

One goal of the invention is therefore to overcome these disadvantages and to provide a ski brake of the above-mentioned type in which each braking plate, even after long use, is operationally moved through a precisely defined angle, and in which in the case of a bending of the braking mandrel, the start of the swivelling operation can be changed within certain limits.

SUMMARY OF THE INVENTION

This goal is achieved inventively by providing on each braking mandrel over a portion of its support section a coarse thread which engages a nut secured on the stepping plate, which engages a threaded hole in the stepping plate or which engages a nut which is secured against rotation relative to the stepping plate and is movable axially of the stepping plate, or by providing on or in the stepping plate two helical slots or surfaces which preferably extend through at least 90°, in or on which the transversely extending sections of the two braking mandrels are guided.

Of course, it is possible to move the nuts independently from one another on both braking mandrels, but in order to simplify the construction of the ski brake, the invention provides that the two nuts associated with the respective braking mandrels are connected by a transverse part which is advantageously biased by a spring which acts longitudinally of the stepping plate, for example a compression spring, the transverse part being urged by the spring, if desired, against at least one stop provided on the stepping plate. The axial movement of the two nuts can, for example, occur by providing on the transverse part, on its side which faces the base plate, a cam or leading edge and by securing a control cam on the base plate which can engage the cam or leading edge of the transverse part. In this manner, the movement of the nuts and thus the angle of rotational movement of the braking mandrels is limited on the one hand by the stop or the stops and on the other hand by the point at which the leading edge of the transverse part, as the stepping plate swings down, comes to rest on the control cam.

According to a different suggestion of the invention, the movement of the two nuts occurs by hinging a flap or lever to the free end of the stepping plate, the lever carrying a control cam which extends transversely of the ski and can engage a sloped surface on a leading edge or cam of the transverse part. The lever can be arranged on the underside of the stepping plate and, in the swung-down position of the stepping plate, have one end supported on the base plate or on the upper side of the ski. The lever, which is biased by an erecting spring which urges it toward a stop, can alternatively, in the braking position, extend through a recess in the stepping plate so that, upon a swinging down of the stepping plate, the ski boot of the user will swing the lever toward the transverse part.

In this connection, it is pointed out that the broad concept of providing stepping plates of ski brakes with a lever or flap biased by a spring is already known, as is disclosed in German OS No. 29 01 900. However, this conventional ski brake does not provide nuts for the adjustment of the braking plates to their retracted position inwardly of the side surfaces of the ski. Rather, the braking plates are provided on a multiply bent bar which is made of spring wire and is bent in its center area like a lyre. The center area has associated with it a wedge-shaped cam which is secured on the side of the flap which faces the stepping plate. This cam, during a swinging down of the stepping plate, urges the two legs of the lyre-shaped section apart. In this manner, the two braking plates are moved toward the longitudinal center plane of the ski. The conventional ski brake thus operates differently from the inventive one discussed above.

In a further inventive solution, the movement of the two nuts with the coarse thread occurs by arranging at least one pair of pivotally connected levers on the underside of the stepping plate, one such lever being hinged to the free end of the stepping plate and the other such lever being hinged to the transverse part or to the nut. The pivot joint of the levers, when the stepping plate is pressed down, engages the base plate or the upper side of the ski and moves the transverse part, against the urging of its springs, toward the transverse axle. The force with which the two braking plates are pressed into their retracted position is in this embodiment, due to the dual lever action, particularly great.

A different inventive possibility for moving the two nuts relative to the braking mandrel support sections includes the support section of each braking mandrel being pivotal within a predefined range in the bearing block on the stepping plate in a vertical plane. A spring is arranged between each bearing block and the associated nut, for example a compression spring, and each nut has on the side remote from the transverse axle of the stepping plate a transversely extending and preferably flat control surface which is inclined at an angle to the braking mandrel pivot axis. This control surface is associated with a corresponding control surface provided on the stepping plate, and during a swinging down of the stepping plate the two control surfaces slide on each other and thereby move each nut, against the force of the associated spring, toward the stepping plate and toward its transverse axle, which results in a simultaneous swinging in of the braking ends of the two braking mandrels to a retracted position inwardly of the sides of the ski. A type of a wedge action occurs in this embodiment, during swinging down of the stepping plate, between the nut and the stepping plate, through which action the force applied by the ski boot is considerably increased.

In this embodiment, it has proven particularly advantageous if, according to a further characteristic of the invention, each nut has at its end which carries the control surface a downward projection which can engage the base plate or the upper side of the ski. The desired path of movement of the two nuts is thus reliably maintained, even if certain wear appears on the base plate or on the upper side of the ski due to use.

However, it is not absolutely necessary that, in order to swing the two braking plates inwardly, only the nuts can be moved longitudinally of the sections of the braking mandrels which carry the coarse threads and are secured against axial movement. Rather, an alternative solution is possible. This further inventive construction of the ski brake is distinguished by the two nuts being secured on the underside of the stepping plate and the two braking mandrels being supported axially movable relative to the stepping plate and being secured against axial adjustment at their ends which are supported under or in the stepping plate in a movable transverse part. The transverse part carries on its surface which faces the nuts a leading edge or cam. Associated with the leading edge or cam of the transverse part is a control cam, which for example can be arranged on the base plate. However, there exists also the possibility of securing the control cam, instead of on the base plate, on a lever pivotally supported on the transverse axle of the stepping plate.

In a further exemplary embodiment according to the invention, the nuts and braking mandrels are moved simultaneously and oppositely. This is done by providing for each braking mandrel or for both braking mandrels an arcuate leaf spring, the two ends of which in the braking position project generally upwardly, one end engaging the associated nut or a transverse part which connects the two nuts and the other end engaging a support member which, like the nut(s), is supported for longitudinal movement on the stepping plate but is secured against rotation with respect thereto.

It has thereby proven particularly advantageous, if the support section of each braking mandrel is supported rotatably in the support member but is secured against axial movement with respect thereto. This embodiment has the advantage that, due to the opposite movements of the support member and nut, the angle of movement of the stepping plate needed to swing the two braking plates toward the longitudinal center plane of the ski is approximately halved for a given pitch of the coarse thread.

There also exists the possibility of providing a threaded hole in the support member for each braking mandrel, which hole engages an oppositely directed thread on the support section of the braking mandrel. This construction does improve the transmission of force from the stepping plate to the two braking mandrels during their movement to the retracted position, but is slightly more expensive because the two thread sections of one braking mandrel must have different diameters in order to make possible the screwing on of the two nuts during assembly. A different solution would be to deform each braking mandrel after at least the nut which is adjacent to the transverse axis has been screwed on. Through this, a uniform diameter of the braking mandrels can be maintained.

A different inventive ski brake is characterized by the two nuts being secured on the underside of the stepping plate near the transverse axle, by a spring acting onto the support section of each braking mandrel and axially urging such section toward the transverse axle, and by a control mechanism being provided which moves each braking mandrel against the force of the spring just prior to the stepping plate coming to rest on the base plate or on the upper side of the ski. This embodiment has the advantage, compared with the first discussed embodiments, that each braking mandrel is held in the nut in the direct vicinity of its transversely extending section which connects the two parallel sections, which causes the torsion angle to be considerably reduced for a given torque on the braking plate and equal mandrel diameters.

Various possibilities exist for the control mechanism. In one, the spring is constructed as a compression spring which has one end supported on a support on the stepping plate and the other end supported on a spring plate which is supported on the mandrel support section, which spring is arranged coaxially with respect to the support section. A lever which is biased by a spring is preferably supported pivotally on the spring plate, which lever can engage a notch provided on the base plate.

In order that the swivelling movement of the two braking plates toward the vertical longitudinal center plane of the ski begins only at a relatively late point in time during movement from the braking to the retracted position, so that the distance of the braking plates from the side surfaces of the ski can be small and the two braking mandrels can advantageously be dimensioned somewhat weaker, the invention provides that each braking mandrel is secured against axial movement relative to the base plate and that, to effect the swivelling movement of the braking mandrels, the stepping plate can be moved longitudinally of the ski and the base plate.

A particularly favorable solution results thereby if, according to a further characteristic of the invention, and to secure the braking mandrels against axial movement, the transverse axle engages an annular groove provided in each braking mandrel and the stepping plate is movable longitudinally of the ski against the urging of at least one spring, for example a tension spring, by means of at least one slot arranged in a member on its underside, which slot extends parallel to the plane of the stepping plate and receives the axle, the stepping plate having a control cam on the base plate associated with it. In this embodiment, the transverse axle is simultaneously utilized for three functions: as a swivel axis, as a member preventing axial movement of the braking mandrel, and as a guide for the stepping plate, which results in significant savings.

The coarse threads can be arranged at the ends of the bent sections of the braking mandrels and the nuts at the narrow side of the approximately cup-shaped stepping plate which is remote from the transverse axle. It is thereby possible in a further development of the invention to form each coarse thread as two diametrically arranged grooves which, at least on one side, are defined by a screw surface and into which two correspondingly formed projections from the narrow side of the stepping plate project, which projections extend in the direction of the sections of the braking mandrels. The coarse threads are preferably provided in cylindrical plastic coatings provided on the braking mandrel support sections. It is possible in this manner to manufacture the coarse thread through castings, rather than through a cutting operation.

Of course, it is not absolutely necessary that the slotted hole of the stepping plate be provided in a member on the same. Rather, it would also be easily possible, according to a further development of the invention, to arrange the bearing block or the bearing blocks for the transverse axle at a location spaced from the lateral boundary edge of the base plate and to provide the slotted holes in the sidewalls of the approximately cup-shaped stepping plate.

Furthermore, it is not necessary that the control cam extend across the entire width of the base plate. Rather, it is quite sufficient if the control cam is inventively arranged only in the center area of the base plate and projects into a groove of the stepping plate, which groove ends in a control surface for the control cam. In this manner, the control cam is not only utilized for controlling rotary movement of the braking mandrels, but also for laterally guiding the stepping plate during the control operation.

In the exemplary embodiments in which on or in the stepping plate there are provided two helical slots which extend through about 90°, or in which there are provided screw surfaces, in or on which the transversely extending sections of the two braking mandrels are guided, it has proven particularly advantageous if, in a further development of the invention, the two sections of the braking mandrels which are supported in or on the stepping plate are supported rotatably in a transverse part, but are secured against axial movement relative thereto, the transverse part having a leading edge which, upon a swinging down of the stepping plate, slides along at least one control cam arranged on the base plate. The transverse part is preferably biased by at least one spring, for example a tension spring, which urges the transverse part along the control cam or cams or toward the transverse axle.

As has already been discussed, there exists the possibility of equipping the stepping plate, instead of with helical slots, with corresponding screw surfaces which guide only on one side the transversely extending braking mandrel sections. It is inventive in this case if torsion springs are arranged on the support sections of the braking mandrels to urge the transversely extending braking mandrel sections against the screw surfaces.

Various modifications exist for the construction of the stepping plate itself. For example, it could be flat and have attachments in which the slots or screw surfaces are provided. A particularly inexpensive solution with respect to its manufacture is distinguished by the stepping plate, according to a different characteristic of the invention, being approximately cup-shaped, whereby the side surfaces of the stepping plate adjacent the side surfaces of the ski, viewed in a cross section, extend according to 90° arcs, the centerpoints of which are coincident with the axes of the braking mandrel support sections. This embodiment has the advantage that the transversely extending braking mandrel sections are supported right next to the side surfaces of the ski, which prevents undesired vibrations during the braking operation.

Finally, in a further development of the invention, at least one stop is arranged on the underside of the stepping plate for limiting movement of the transverse part or the braking mandrel under the urging of the spring or springs. In this manner, the range of movement of the two braking mandrels is reliably limited and sliding of the transversely extending braking mandrel sections out of the slots is prevented.

BRIEF DESCRIPTION OF THE DRAWINGS

Various exemplary embodiments of the inventive ski brake are illustrated in the drawings.

DETAILED DESCRIPTION

Figure 1:
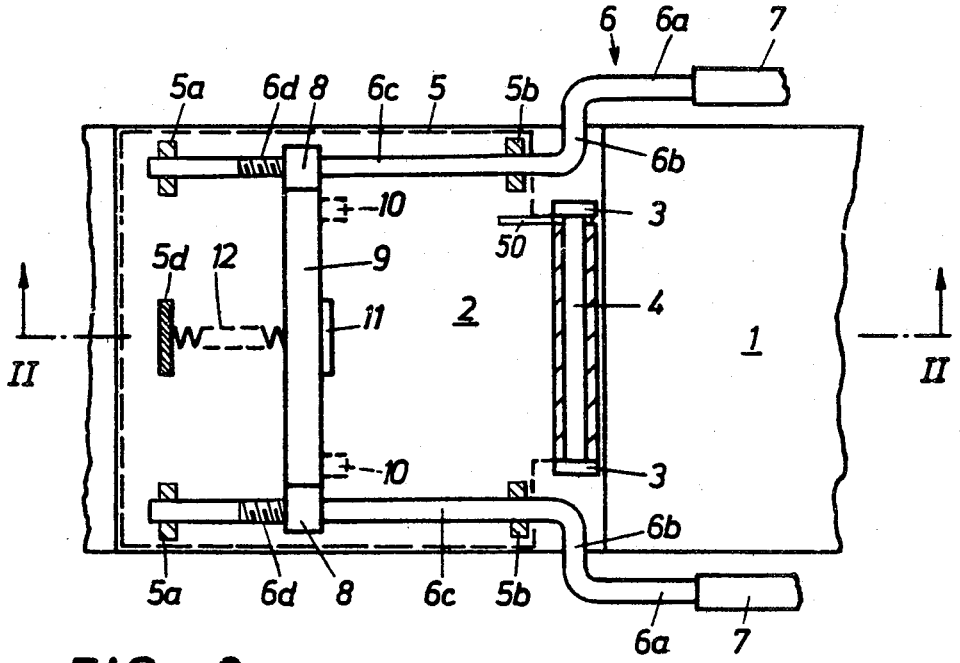
FIG. 1 is a sectional top view of a first exemplary embodiment taken along the line I—I of FIG. 2, wherein the stepping plate is indicated only by dashed lines in order to facilitate a clearer illustration.
Figure 2:
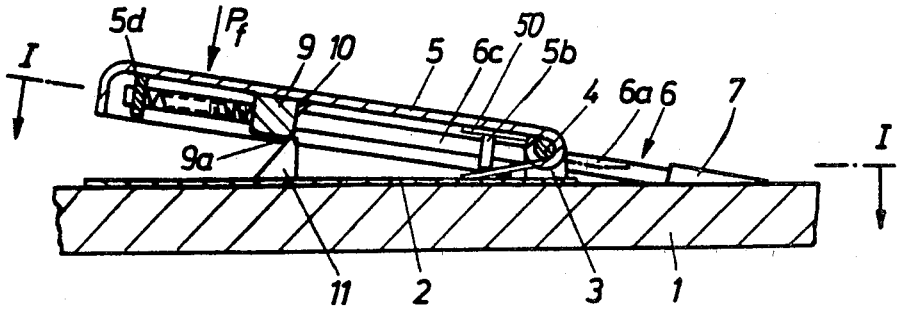
FIG. 2 is a sectional view taken along the line II—II of FIG. 1, according to which the stepping plate is partly, but is not totally, swung down.
Figure 3:
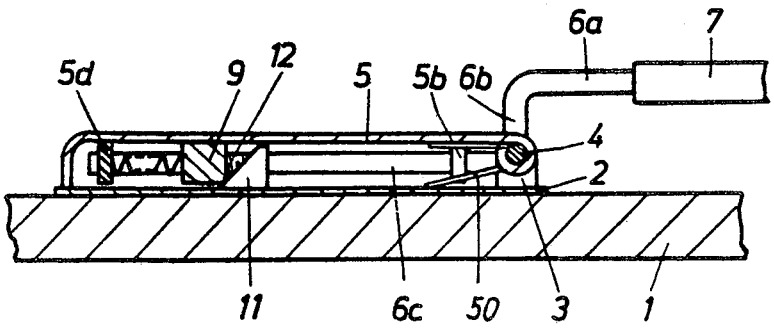
FIG. 3 is a view similar to FIG. 2 showing the ski brake in its retracted position.

The ski brake which is illustrated in FIGS. 1 to 3 has a base plate 2 which is fastened to a ski 1 and has two bearing eyes 3 which support a transverse axle 4 for a stepping plate 5 which is pivotally biased in a conventional manner by an erecting spring which is not illustrated. The stepping plate 5 carries on its underside two bearing blocks 5*a* and two bearing blocks 5*b* in which support sections 6*c* of two bent braking mandrels 6 are supported for rotation but are secured in a conventional and not-illustrated manner against axial movement. Extending parallel to the sections 6*c* are the sections 6*a* of the braking mandrels 6 which each carry a braking plate 7. The sections 6*a* are each connected by a transversely extending section 6*b* to the corresponding section 6*c*. Each of the sections 6*c* carries on a part of its length a coarse thread 6*d*, in other words a thread with a relatively large pitch, which threadedly engages a nut 8. The nuts 8 are connected by a transversely extending part 9. A compression spring 12 engages the transverse part 9 and urges it toward two stops 10 which are secured on the stepping plate 5, the spring 12 having its opposite end supported on a downwardly projecting support 5*d* of the stepping plate. It may at times be advantageous to integrate the support 5*d* and the two bearing blocks 5*a* into a single transversely extending rib. A wedge-shaped control cam 11 is secured on the base plate 2, which control cam has an inclined surface which can engage a rounded edge 9*a* provided on the transverse part 9.

The ski brake of FIGS. 1 to 3 operates as follows. In the braking position, the sections 6*a* of the two braking mandrels 6 and thus the braking plates 7 project downwardly beyond the ski running surface, the stepping plate 5 being, under the urging of the not-illustrated erecting spring, maintained in its upwardly swung position. The stops 10 thus define the angular position of the braking plates 7.

In other words, the transversely extending part 9 is, in response to the urging of the spring 12, in a position in which it is engaging the stops 10, and the position of the nuts 8 thereon relative to the braking mandrels 6 defines, due to the cooperation between the nuts 8 and the threads 6*d* on the mandrels 6, the angular position of the mandrels 6 and braking plates 7 shown in FIG. 1.

If a downward force is now applied by a not-illustrated ski boot onto the stepping plate 5, then the latter is swung toward the upper side of the ski and the sections 6*a* of the braking mandrels 6, which sections carry the braking plates 7, swing upwardly past the sides of the ski. This movement ends as soon as the rounded-off edge 9*a* of the transverse part 9 comes into contact with the control cam 11 of the base plate 2, as shown in FIG. 2.

If now the force which is applied by the ski boot onto the stepping plate 5 in the direction of the arrow $P_f$ in FIG. 2 is increased, then the edge 9*a* of the transverse part 9 slides downwardly along the inclined surface of the control cam 11. This causes the transverse part 9 and the two nuts 8 thereon to be moved longitudinally of the stepping plate 5 away from the stops 10 and, due to the cooperation of the nuts 8 and the coarse threads 6*d*, causes the support sections 6*c* of the two braking mandrels 6 to rotate approximately 90°. Through this rotational movement, the sections 6*b* of the two braking mandrels move from the horizontal position according to FIG. 2 into the vertical position according to FIG. 3 in which the sections 6*a* of the braking mandrels 6 and the braking plates 7 lie above the upper side of the ski and inwardly of the sides of the ski.

If the ski boot thereafter leaves the upper side of the ski, then the stepping plate 5 is swung upwardly by the urging of its erecting spring and the compression spring 12. At the same time, the compression spring 12 moves the transverse part 9 until it again rests on the stops 10, whereby the sections 6*c* are rotated by the two nuts 8 so that the braking plates 7, as viewed from above, again lie outwardly of the sides of the ski. This position is achieved as soon as the rounded edge 9*a* of the transverse part 9 has left the inclined surface of the control cam 11. The stepping plate 5 thereafter continues to pivot until the predetermined braking position of the braking plates 7 has been reached, such position being defined by a conventional and not-illustrated stop.

The embodiments according to FIGS. 4 and 5 and FIGS. 6 and 7 are similar to the first exemplary embodiment with respect to the design of the stepping plate 5 and the two braking mandrels 6.

Figure 4:
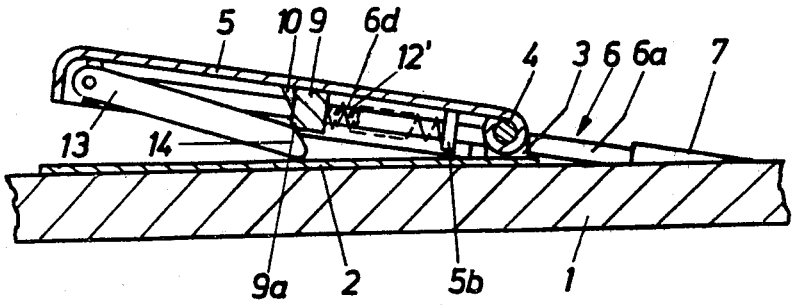
FIGS. 4 and 5, 6 and 7, 8 and 9, 10 and 11, 12 and 13, 14, 14*a* and 15, and 16 and 17 are sectional views of further exemplary embodiments, the sectional views of each such embodiment respectively corresponding to the views of FIGS. 2 and 3.
Figure 5:
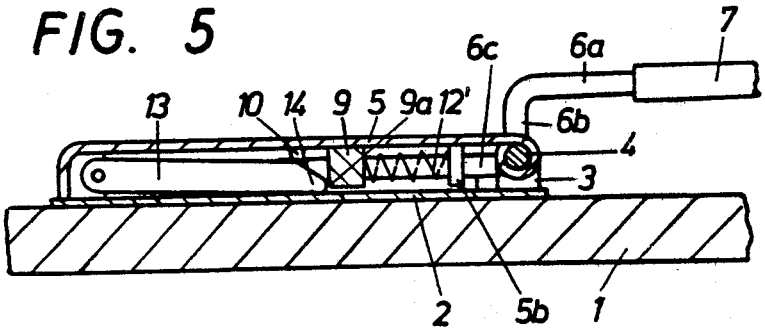

In order to move the nuts 8 at the end of the path of swing of the stepping plate 5 from the position according to FIG. 4 into the position according to FIG. 5, however, a lever 13 is hinged to the free end of the stepping plate and carries a control cam 14 which extends transversely of the ski. In the exemplary embodiment according to FIGS. 4 and 5, the lever 13 is arranged on the underside of the stepping plate 5 and toward the end of the path of swing of the stepping plate 5 engages the base plate 2. The two nuts 8 are again connected by a transverse part 9 and two springs 12′ arranged coaxially on the sections 6*c* of the respective braking mandrels 6 each have one end supported on a bearing block 5*b* and the other end supported on the associated nut 8. In this manner, the transverse part 9 is urged toward the stops 10 and movement of the part 9 and the nuts 8 effects rotation of the braking mandrels.

When a ski boot steps into the not-illustrated ski binding, the stepping plate 5 is swung downwardly by the ski boot until the lever 13 engages the base plate 2 and pivots so that the control cam 14 engages the edge 9*a* of the transverse part 9, as shown in FIG. 4. If the force applied by the ski boot is now increased, then the control cam 14 on the lever 13 moves the transverse part 9 with the two nuts 8 toward the transverse axle 4 as the lever 13 pivots, which causes the two springs 12′ to be slightly compressed and the two braking plates 7 to be swung into the position above the ski. Thus, the retracted position of FIG. 5 is achieved.

When the ski boot thereafter leaves the surface of the ski, the erecting spring and the springs 12′ return the stepping plate 5 and lever 13 to the position of FIG. 4, the transverse part 9 being returned to its position engaging the stops 10 and the nuts 8 thereby effecting rotational movement of the mandrels 6 from the position of FIG. 5 to the position of FIG. 4. Thereafter, the erecting spring pivots the stepping plate 5 until the ski brake is in the braking position.

Figure 6:
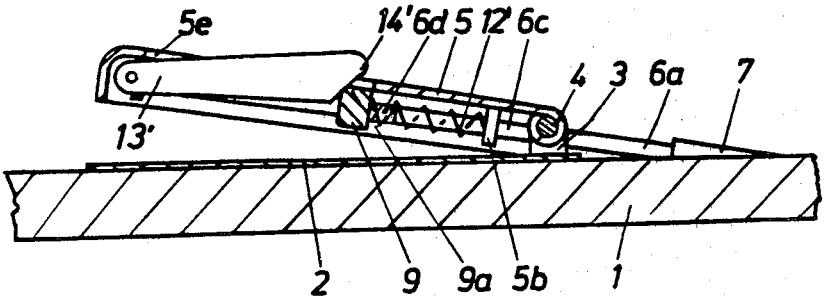
Figure 7:
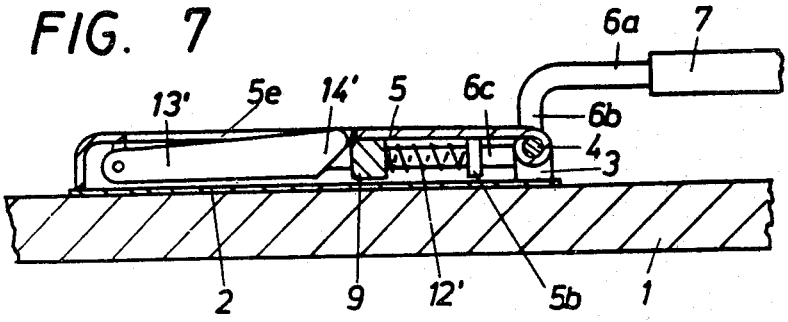

The exemplary embodiment according to FIGS. 6 and 7 differs from the just described one primarily in that the lever 13′ with the control cam 14′ extends through a recess 5*e* provided in the stepping plate 5. The lever 13′ can be maintained in position by a conventional and not-illustrated spring in the braking position of the ski brake, in which position it defines a certain angle with the stepping plate 5. During the swinging down of the stepping plate 5 by a ski boot, the boot sole acts directly on the lever 13′. In other respects, the design and function of the ski brake according to FIGS. 6 and 7 corresponds with that of the ski brake according to FIGS. 4 and 5 and is therefore not described in further detail.

Figure 8:
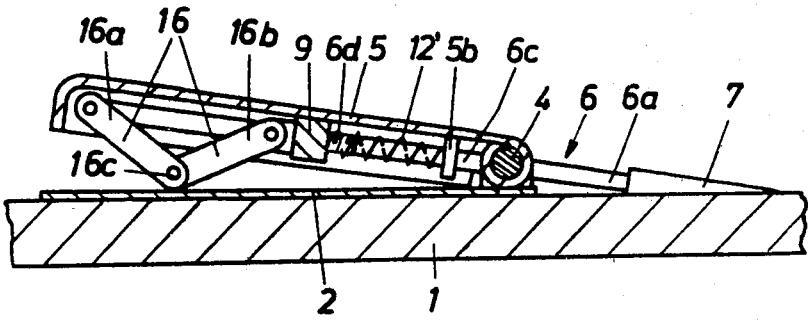
Figure 9:
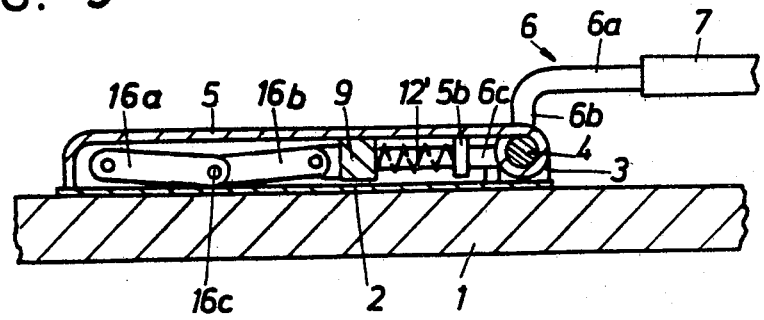

A further embodiment is illustrated in FIGS. 8 and 9, which is generally similar in design to the previously discussed ski brakes. To avoid a lengthy discussion, only the differences are discussed, which include at least one pair of pivotally connected levers 16*a* and 16*b* which are arranged on the underside of the stepping plate and effect movement of the transverse part 9 in the direction of the swivel axle 4 against the urging of the springs 12′. The region of the joint 16*c* of the pair of levers 16*a* and 16*b* engages the base plate 2 as soon as the stepping plate 5 has been swung by the ski boot through a pregiven angle to the position of FIG. 8. The lever 16*a* has one end pivotally supported at the free end of the stepping plate 5 and the lever 16*b* has an end pivotally supported on the transverse part 9. The levers 16*a* and 16*b* are each adjacent and extend substantially parallel to the base plate 2 in the retracted position of the ski brake (FIG. 9). As in the preceding exemplary embodiments, the angular positions of the braking plates 7, in the braking position, are defined by stops, not illustrated here, toward which the transverse part 9 is urged by the springs 12'.

In other words, when the stepping plate 5 is pivoted from the braking position toward the retracted position, for example by a ski boot, the area of the joint 16*c* of the levers 16*a* and 16*b* comes into contact with the base plate 2. Further pivotal movement of the stepping plate 5 to the braking positions causes the levers 16*a* and 16*b* to move to the position of FIG. 9, thereby moving the transverse part 9 to the right against the urging of the springs 12', whereby the nuts thereon coact with the threads 6*d* and rotate the mandrel 6 so as to move the braking plates 7 to a retracted position inwardly of the sides of the ski. This sequence of events occurs in a reverse order when the ski brake is moved from the retracted to the braking position by its erecting spring and the springs 12'.

Figure 10:
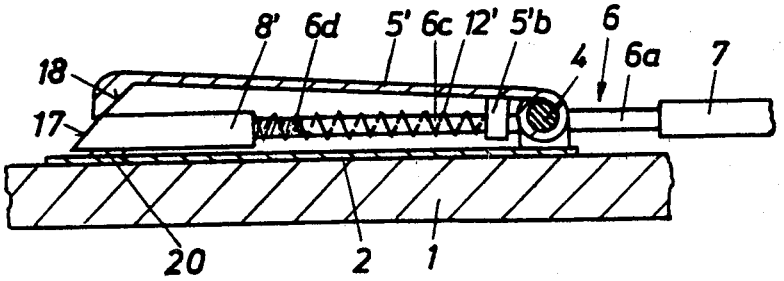
Figure 11:
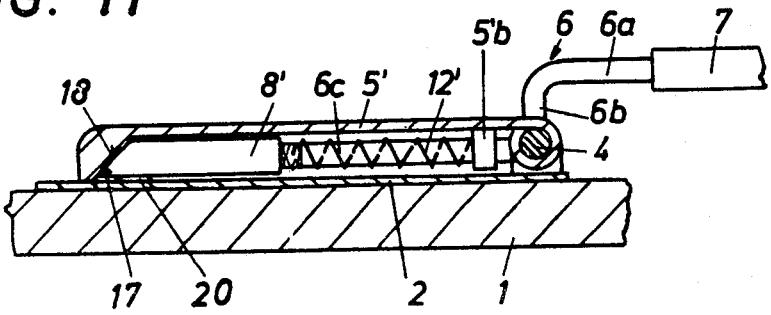

The embodiment according to FIGS. 10 and 11 differs from the preceding exemplary embodiments in that each of the two braking mandrels 6 is supported in only a single bearing block 5'*b* of the stepping plate 5'. The bearing blocks 5'*b*, however, make it possible for each braking mandrel 6 not only to rotate about the axis of the section 6*c*, but also to carry out a limited swivelling movement in a vertical longitudinal plane with respect to the stepping plate 5'. Thus, the bore through each bearing block 5'*b* enlarges in diameter in a direction away from the swivel axle 4. The nuts 8' which engage the coarse threads 6*d* of the section 6*c* of the respective braking mandrels 6 are considerably longer than the nuts of previously described embodiments and each has an end with a sloped surface 17 which is cooperable with a sloped surface 18 provided on the underside of the stepping plate 5'. A spring 12' is provided on each braking mandrel 6 between the corresponding nut 8' and bearing block 5'*b*. Furthermore, each nut 8' has at its end which has the sloped surface 17 a downward projection 20 to assure a reliable rotation of each of the braking mandrels 6.

Each spring 12', in the braking position of the ski brake, urges the sloped surface 17 of the associated nut 8' against the sloped surface 18 of the stepping plate 5', so that the two nuts 8' slide along the sloped surface 18 and move away from the stepping plate 5'. The angle of movement of each nut 8' or section 6*c* of the individual braking mandrels 6 with respect to the stepping plate 5' depends on the angle of divergence of the bore of the bearing block 5'*b*.

If now a force is applied onto the stepping plate 5' by a ski boot, then the stepping plate first pivots about the transverse axle 4 until the projection 20 of the nut 8' rests on the base plate 2, as shown in FIG. 10. At this moment, the position in which the braking mandrels 6 extend parallel to the upper side of the ski has almost been reached. If now the force applied onto the stepping plate 5' is increased, each nut 8' slides with its sloped surface 17 along the sloped surface 18 of the stepping plate 5', causing the spring 12' to be slightly compressed and the nut 8' to move relative to the coarse thread 6*d* on the section 6*c* in a direction toward the transverse axle 4. Through this, the braking plate 7 is rotated through approximately 9020 and, simultaneously therewith, the stepping plate 5' and the two braking mandrels 6 move to the retracted position in which they are parallel to the base plate 2, as shown in FIG. 11.

If the ski boot leaves the upper side of the ski, then the stepping plate 5' moves first under the influence of the not-illustrated erecting spring and the two springs 12' to the position of FIG. 10. During this movement, each nut 8' slides with its sloped surface 17 along the sloped surface 18 of the stepping plate 5', which results in an outward swinging of the sections 6*a* of the braking mandrels 6 which carry the braking plates 7. Swivelling of the stepping plate 5' then continues under the urging of the erecting spring until the braking position of the braking plates 7 is reached.

Figure 12:
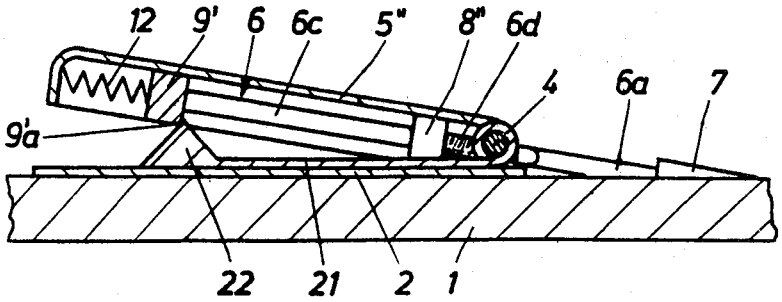
Figure 13:
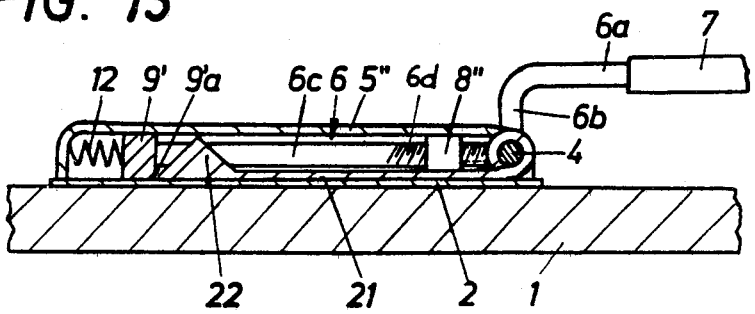

A further embodiment which differs from the ski brakes described up to now is illustrated in FIGS. 12 and 13. Here, the two braking mandrels 6 are not only rotatably supported in the stepping plate 5'', but are also supported for axial movement within a pregiven range. Two nuts 8'', which threadedly engage the coarse threads 6*d* on the sections 6*c* of the braking mandrels 6, are secured on the stepping plate 5'', for example by welding. A lever 21 is, independently of the stepping plate 5'', pivotally supported on the transverse axle 4 and, in the braking position of the ski brake, is positioned at an acute angle with respect to the stepping plate 5'' therebelow, the angle of movement of such lever relative to the stepping plate 5'' being limited by a stop (not illustrated). The lever 21 carries at its free end a wedge-shaped control cam 22 which can engage the rounded edge 9'*a* of the transverse part 9'. The transverse part 9' is biased by a compression spring 12 in a manner similar to that illustrated in FIG. 1, in which transverse part 9' the ends of the mandrel sections 6*c* are supported rotatably but are secured against axial movement relative thereto. It is also possible to provide on the underside of the lever 21, as in the embodiment according to FIGS. 10 and 11, a downward projection.

The stepping plate 5'', when a boot steps into the binding, is first swung toward the base plate 2 until the lever 21 rests on the base plate 2, as shown in FIG. 12. If thereafter the pressure exerted by the ski boot is increased, then the rounded leading edge 9'*a* of the transverse part 9' slides downwardly along the control cam 22, causing an axial movement of the two braking mandrels 6 and thus, due to the cooperation between the nuts 8'' and the coarse threads 6*d* on the sections 6*c*, an upward rotation through 90° of the braking plates 7. Thus, the ski brake is moved to the retracted position shown in FIG. 13.

If the ski boot leaves the ski, then the stepping plate 5'' is swung first into the position shown in FIG. 12 under the influence of the compression spring 12 and the not-illustrated erecting spring and, simultaneously therewith, the transverse part 9' with its leading edge 9'*a* slides upwardly along the control cam 22 due to the urging of the spring 12. The two braking mandrels 6 are thereby moved axially and, since their threaded sections 6*d* engage the nuts 8'' which are secured on the stepping plate 5'', are rotated 90° so that the two braking plates 7 lie, in a top view of the upper side of the ski, laterally outwardly of the sides of the ski (FIG. 12). Further pivotal movement of the stepping plate 5'' together with the lever 21 occurs thereafter under the urging of the erecting spring until the two braking plates 7 have reached their braking position.

Figure 14:
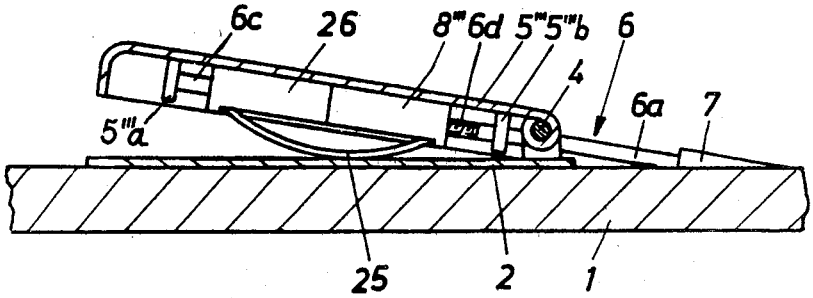
Figure 15:
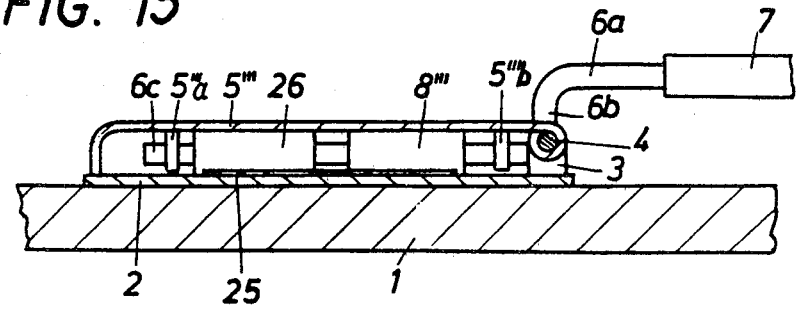

In the exemplary embodiment according to FIGS. 14 and 15, two arcuate leaf springs 25 are provided on the stepping plate 5'''. The two ends of each leaf spring 25 project generally upwardly in the braking position, one end engaging the associated nut 8''' and the other end engaging a support member 26. Nut 8''' and support member 26 are supported for movement in the longitudinal direction on the stepping plate 5''' but are secured against rotation. The support section 6c of the associated braking mandrel 6 is supported rotatably in each support member 26 but is secured against axial movement with respect thereto.

If the stepping plate 5''' is swung downwardly against the urging of the not-illustrated erecting spring by a ski boot, the center area of the arcuate leaf spring 25 comes into engagement with the base plate 2, as shown in FIG. 14. If now the force exerted by the ski boot is increased, each leaf spring 25 urges the associated nut 8''' and support member 26 apart. This results in relative movement between the section 6c of each braking mandrel 6 which carries the coarse thread 6d and the associated nut 8''', which movement causes a swinging of the braking plates 7 toward the vertical longitudinal center plane of the ski. At the end of the pivotal movement of the stepping plate 5''', it rests adjacent and parallel to the base plate 2 with the leaf spring, which in the meantime has been pressed flat, therebetween. The two braking plates 7, viewed from above, then lie inwardly of the sides of the ski 1, as shown in FIG. 15.

If the ski boot leaves the ski, then the stepping plate 5'', is first pivoted upwardly under the urging of the individual leaf springs 25 and the not-illustrated erecting spring until the adjacent ends of the support members 26 and the nuts 8''' butt against one another. During this swivelling movement, relative movement occurs between the coarse thread 6d of each section 6c and the associated nut 8''', which results in a 90° rotation of each braking mandrel 6 so that the braking plates 7 now lie outwardly of the sides of the ski. The pivotal movement of the stepping plate 5''' about the transverse axle 4 is thereafter continued until the braking position of the two braking mandrels 6 is reached, which position is determined in a conventional manner by a conventional and not-illustrated stop.

Figure 14A:
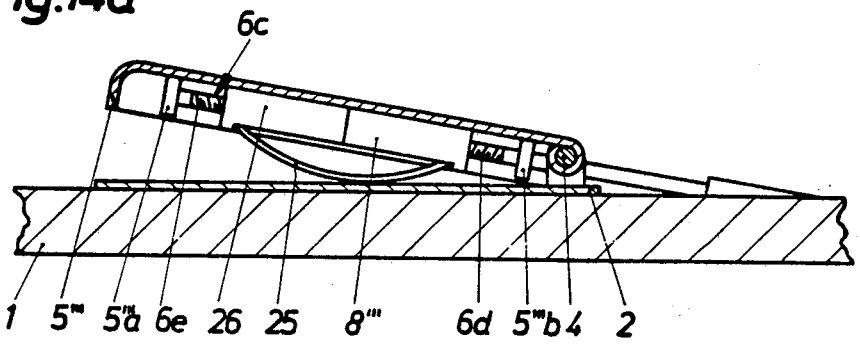

FIG. 14a is a slightly different modification of the embodiment according to FIGS. 14 and 15. The support member 26 is provided with a threaded hole which cooperates with a part of the bent section 6c of the braking mandrel 6 which carries a thread 6e oppositely directed to the thread 6d. If in this case both threads 6d, 6e have the same pitch, then rotary movement of the braking mandrel will occur, but not axial movement.

Figure 16:
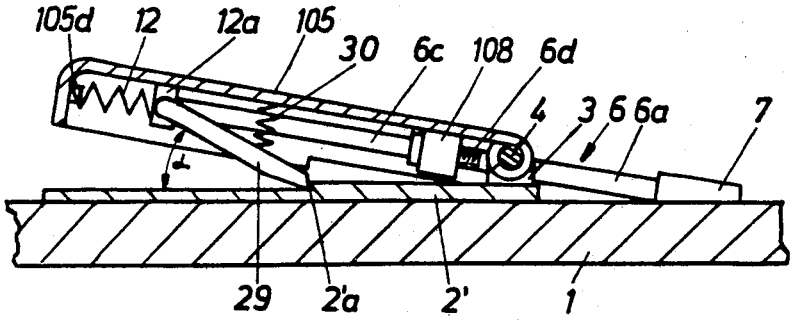
Figure 17:
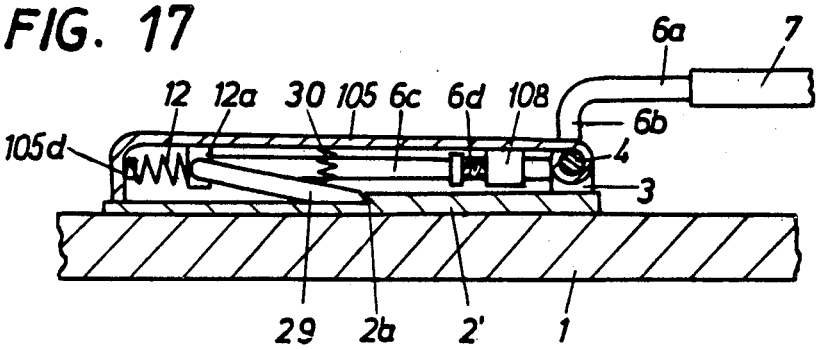

In the embodiment according to FIGS. 16 and 17, two nuts 108 are secured, for example by welding, on the underside of the stepping plate 105 near its transverse axle 4. As in the preceding exemplary embodiments, each nut 108 threadedly engages a portion of the section 6c of each braking mandrel 6 which is provided with a coarse thread 6d. In the area of its end which is remote from the transverse axle 4, the section 6c carries a compression spring 12, which has one end supported on a support 105d of the stepping plate 105 and its other end supported on a spring plate 12a. The spring 12 urges the spring plate 12a toward the transverse axle 4. A lever 29 is pivotally supported on the spring plate 12 and, in the braking position of the ski brake, is urged by a spring 30 to a position in which it defines an acute angle with the stepping plate 105. The free end of the lever 29 can engage a notch 2'a provided in the base plate 2'.

An end of each braking mandrel 6 is rotatably supported in the spring plate 12a but secured in a conventional manner against axial movement with respect thereto.

If the stepping plate 105 is now pivoted by a ski boot to a position near the base plate 2', the free end of the lever 29 comes into engagement with the notch 2'a of the base plate 2' (FIG. 16). If thereafter the force which is applied by the ski boot is increased, then the stepping plate 105 is swung to a position against the base plate 2' and simultaneously the lever 29 is swung to a position against the stepping plate 105. Since the free end of the lever 29 is engaged with the notch 2'a in the base plate 2', its other end moves the spring plate 12a and thus the braking mandrel 6 away from the transverse axle 4. This, due to cooperation between the nuts 8 and threads 6d, causes each braking mandrel to pivot and move the associated braking plate 7 into the retracted position above the ski 1, as shown in FIG. 17.

If the ski boot leaves the stepping plate 105, the stepping plate is swung under the influence of the compression spring 12 and the not-illustrated erecting spring from the position according to FIG. 17 to the position according to FIG. 16. During this pivotal movement, the sections 6c of the braking mandrels 6 are moved axially and, since their coarse threads 6d threadedly engage the two nuts 108, are also rotated by 90°, so that the two braking plates 7 lie outwardly of the sides of the ski. The stepping plate 105 is thereafter pivoted further by the erecting spring until the braking position is reached.

Figure 18:
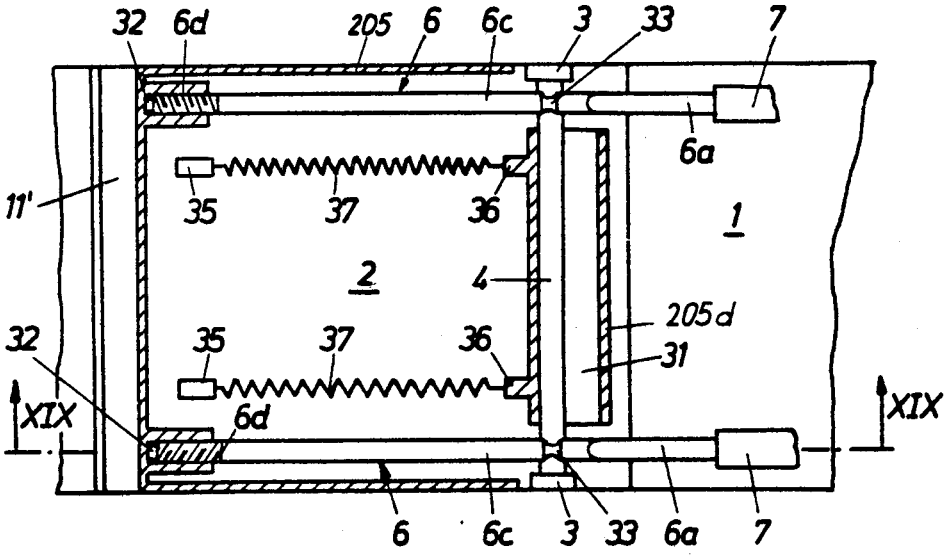
FIGS. 18 to 20 illustrate a further exemplary embodiment of the inventive ski brake, FIG. 18 being a top view of the ski brake in the retracted position taken along line XVIII—XVIII of FIG. 19, FIG. 19 being a sectional view taken along line XIX—XIX of FIG. 18, and FIG. 20 being a sectional view similar to FIG. 19 but showing the ski brake in an intermediate position of operation.
Figure 19:
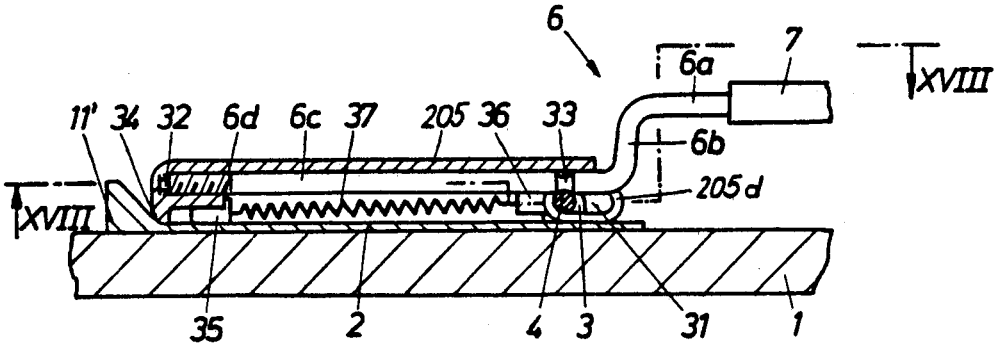
Figure 20:
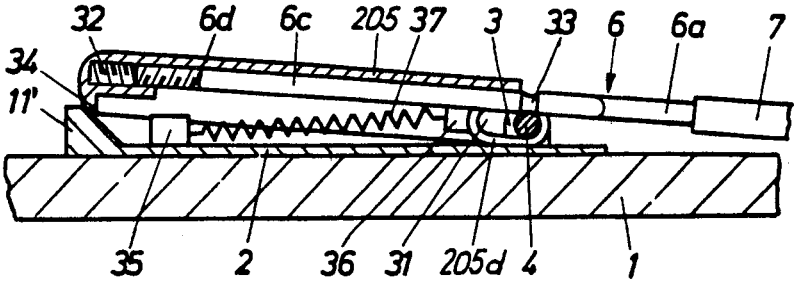
Figure 18A:
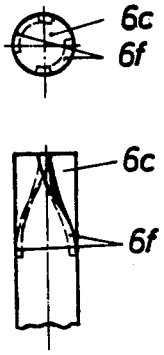
FIGS. 18*a*, 18*b*, 19*a* and 19*b* illustrate modifications of the embodiment shown in FIGS. 18 to 20.
Figure 19A:
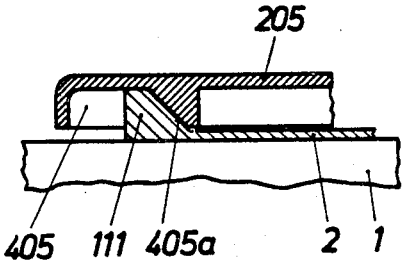
Figure 18B:
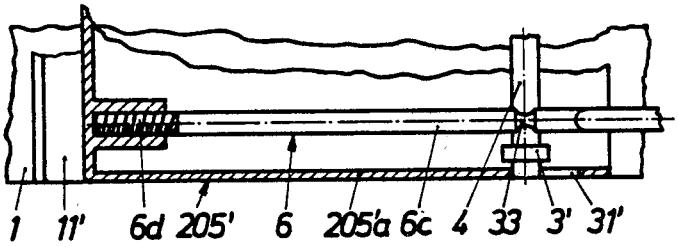
Figure 19B:
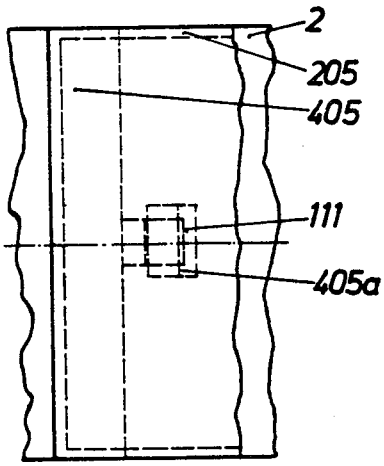

According to the exemplary embodiment of FIGS. 18 to 20, the base plate 2 carries at one end a control cam 11' and at the other end two bearing eyes 3 for the transverse axle 4. The stepping plate 205 is supported for movement rotationally and longitudinally of the ski within a pregiven range on the transverse axle 4. The stepping plate 205 carries for this purpose on its underside a member 205d, in which is provided a slot 31 which extends parallel to the stepping plate. The transverse axis 4 extends through the slot 31.

Two braking mandrels 6 are supported in the stepping plate 205. The coarse thread 6d of each braking mandrel 6 engages a threaded hole 32 or the like provided in the front area of the stepping plate 205. The other end of the section 6c, which end is adjacent the section 6b, has an annular groove 33 which is engaged by the transverse axle 4. The opposite side of each section 6c is supported against the underside of the stepping plate 205, which thus has the function of a bearing surface. The end of the approximately cup-shaped stepping plate 205 which is remote from the transverse axle 4 has a rounded portion 34 at its lower end which, when the stepping plate 205 is swung downwardly, can engage the sequence switch cam 11'. Furthermore, projections 35 and 36 are secured on the base plate 2 and on the member 205d of the stepping plate 205, between which projections are operatively arranged tension springs 37. The projections 35 project upwardly, whereas the projections 36 project longitudinally. The stepping plate 205 is, in a conventional manner, biased by a not-illustrated erecting spring.

This inventive ski brake functions as follows. The two braking plates 7 project, in the braking position, downwardly beyond the running surface of the ski at an acute angle. When the ski 1 is to be used, the ski boot of the user will first swing the stepping plate 205 against the action of the not-illustrated erecting spring to the position illustrated in FIG. 20. In this position, the two braking plates 7 are still outward of the ski sides in a top view of the ski 1. If now the force which the ski boot applies is increased, then the rounded portion 34 of the stepping plate 205 slides, against the pull of the two tension springs 37, downwardly along the sequence switch cam 11' toward the upper side of the ski. The two tension springs 37 are thereby stretched, and the stepping plate 205 moves longitudinally of the ski so that the transverse axle 4, which in the braking position of the ski brake rests at the right end of the slot 31 under the urging of the springs 37, is now disposed at the other end of the slot 31, as shown in FIGS. 18 and 19. Due to this movement of the stepping plate 205 relative to the axle 4, the coarse thread **6*d* of each of the braking mandrel sections 6*c* moves axially with respect to the associated threaded hole 32, which results in a 90° rotation of the two braking mandrels 6 to the position shown in FIG. 19. The two braking plates 7** therefore are, as seen from above, disposed inwardly of the sides of the ski. The retracted position of the ski brake is thus reached.

If the ski boot now leaves the upper side of the ski, then the stepping plate 205 moves first from the position according to FIG. 19 to the position according to FIG. 20 under the influence of the two tension springs 37 and the not-illustrated erecting spring, the rounded portion 34 of the stepping plate 205 sliding upwardly along the sequence switch cam 11'. The transverse axle 4 at the same time returns to the right end of the slot 31, and the coarse thread **6*d* of each section 6*c* cooperates with the associated threaded hole 32 of the stepping plate 205 to cause each braking mandrel 6 to rotate around the axis of its section 6*c* by 90°, so that the two braking plates 7 will now lie, in a top view of the ski, outwardly of the sides of the ski. The stepping plate 205 together with the two braking mandrels 6 can now, under the influence of the erecting spring, be pivoted to the braking position in which the two braking plates 7** project downwardly beyond the running surface of the ski.

FIG. **18*b* is a modification of the embodiment shown in FIGS. 18 to 20. The bearing blocks 3' for the transverse axle 4 are spaced from the lateral boundary edge of the base plate 2. The slots 31' are provided in the sides of the stepping plate 205'** which is approximately cup-shaped.

Further it is possible, as illustrated in FIG. **18*a*, to define the coarse thread by two diametrically helical grooves 6*f*, into which project two not illustrated corresponding projections provided on the sides of the stepping plate and extending toward the sections 6*c* of the braking mandrels 6. The course thread 6*f* is provided preferably in cylindrical plastic coatings provided on the two braking mandrel sections 6*c***.

FIGS. **19*a* and 19*b* illustrate a further modification of the embodiment according to FIGS. 18 and 19. The control cam 111 is only arranged in the center of the base plate 2 and projects into a groove 405 in the stepping plate 205. The groove 405 ends in a control surface 405*a* for the control cam 111**.

Figure 21A:
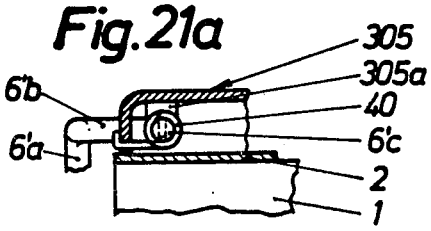
FIGS. 21*a* and 21*b* show a modification of the embodiment illustrated in FIGS. 21 to 23.
Figure 21B:
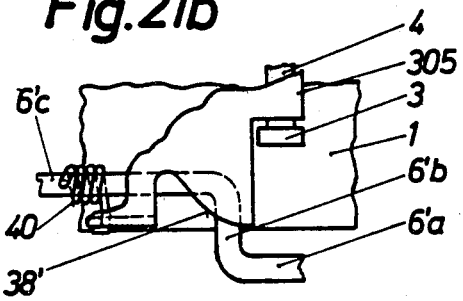
Figure 21:
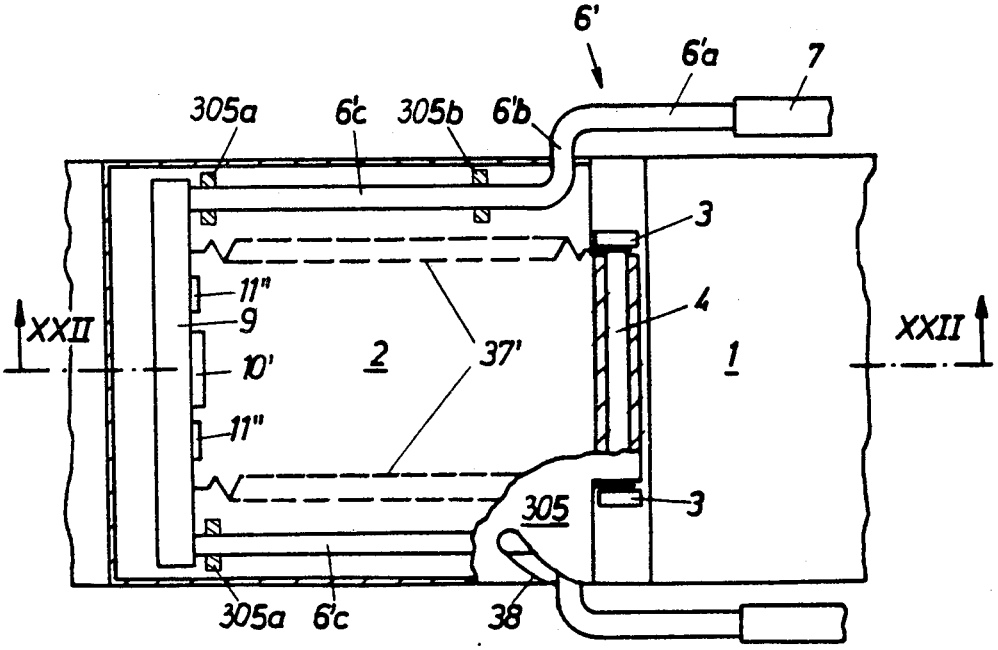
FIG. 21 is a sectional top view of a different embodiment of the inventive ski brake in an intermediate position of operation taken along the line XXI—XXI of FIG. 22.
Figure 22:
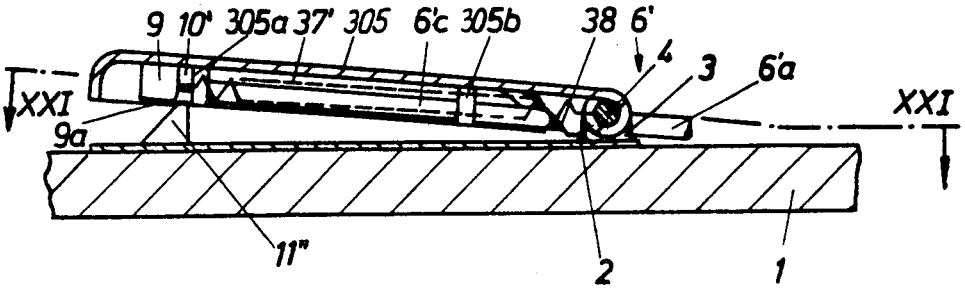
FIG. 22 is a sectional view taken along the line XXII—XXII of FIG. 21.
Figure 23:
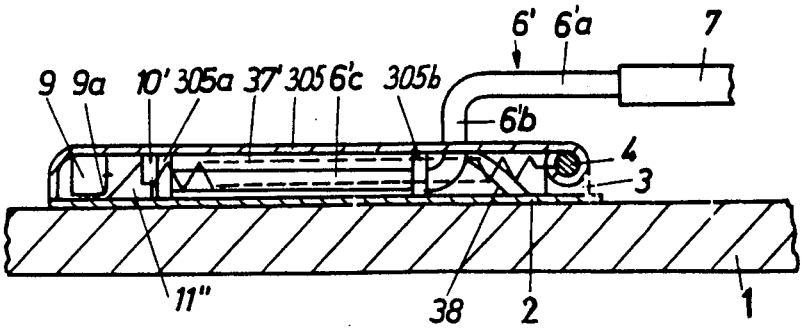
FIG. 23 is a sectional view similar to FIG. 22 but showing the ski brake in its retracted position.

The ski brake which is illustrated in FIGS. 21 to 23 has two braking mandrels 6' which are supported rotatably and axially movably in bearing blocks **305*a* and 305*b* of the stepping plate. Two wedge-shaped control cams 11'' are secured on the base plate 2 at a location spaced from the transverse axle 4. They each have an inclined surface which is engaged by a rounded-off leading edge 9*a* on a transverse part 9 when the stepping plate 305 is swung down by a ski boot. In the portions of the stepping plate 305 adjacent the side surfaces of the ski 1, there are provided steeply extending helical slots 38, which have the sections 6'*b* of the two braking mandrels 6' extending therethrough and serve as guideways for these braking mandrel sections. The slots 38 extend, viewed in the direction of the axis of the sections 6'*c***, through an angle of about 90°.

In order to limit the axial movement of the braking mandrels 6' and the transverse part 9, and in order to prevent the two sections **6'*b* from leaving the slots 38, at least one stop 10' is arranged on the underside of the stepping plate 305. The stepping plate is constructed approximately cup-shaped, its two edges which are adjacent the side surfaces of the ski 1, viewed in cross section, each having the shape of one-fourth of an ellipse. The section 6'*c* of each braking mandrel 6'** is arranged at the point of intersection of the major and minor ellipse axes.

The inventive ski brake functions as follows. When the skier steps into a not-illustrated binding on the ski, the stepping plate 305 is first swung downwardly by the ski boot against the urging of the not-illustrated erecting spring until the position of FIG. 22 is reached, in which position the two braking plates 7 are still disposed outwardly of the sides of the ski 1. If now the force applied by the ski boot is increased, the rounded-off leading edge **9*a* of the transverse part 9 will slide downwardly along the control cam 11'' toward the base plate 2. This causes the transverse part 9 and the two braking mandrels 6' to be moved away from the transverse axle 4 against the urging of the tension springs 37'. This results in the sections 6'*b* of the two braking mandrels 6' sliding along the helical slots 38, which results in a 90° rotation of the braking mandrels 6' about the axes of the sections 6'*a*. Therefore, the two braking plates 7 are, as soon as the retracted position of the ski brake illustrated in FIG. 23** is reached, viewed in a top view, located inwardly of the sides of the ski.

If the ski boot leaves the ski binding, then the stepping plate 305 is swung by the urging of the not-illustrated erecting spring and the tension springs 37' from the position according to FIG. 23 to the position according to FIG. 22, whereby the leading edge **9*a* of the transverse part 9 slides upwardly along the sequence switch cam 11''. This causes the transverse part 9 and the two braking mandrels 6' to be moved toward the transverse axle 4 until the transverse part 9 engages the stop 10'. This movement causes the section 6'*b* of the two braking mandrels 6' to move along the helical slots 38, which results in a 90° rotation of the two braking mandrels about the respective axes of their sections 6'*c*. The braking plates 7 lie, at the end of this movement, outwardly of the side surfaces of the ski, so that they will not interfere with further pivotal movement of the stepping plate 305 to the braking position. The stepping plate can now be swung to the braking position by the urging of the erecting spring, in which position the two braking plates 7 project downwardly beyond the running surface of the ski 1**.

A variation of the just described embodiment is illustrated in FIGS. **21*a* and 21*b*. Instead of the helical slots the stepping plate 305 is provided with screw surface 38'. On the sections 6'*c* of the braking mandrel 6' are arranged torsion springs 40, which are supported on or in the stepping plate 305 and which press the transversely extending braking mandrel sections 6'b against the screw surfaces 38'**.

The invention, of course, is by no means limited to the exemplary embodiment which is illustrated in the drawings and described above. Rather, other embodiments of ski brakes may fall within the protection of the invention. Moreover, variations or modifications of the disclosed embodiments, including the rearrangement of parts, lie within the scope of the present invention.

Thus, it is possible in the exemplary embodiment according to FIGS. 14 and 15 to connect the two nuts through a common transverse part and to provide a common support member for the two braking mandrels. In this case, a single leaf spring would be sufficient, which would simplify the construction but would increase the weight of the ski brake.

Furthermore, it would be possible to secure the leaf spring on the base plate instead of on the stepping plate, for example by means of a rivet, and to permit the ends of the leaf spring to engage grooves in the nuts or in the transverse part and in the support member, and possibly to engage grooves in the support members only during the swinging down of the stepping plate against the urging of the erecting spring.

The nuts which are secured on the stepping plate according to FIGS. 16 and 17 can be replaced with members on the stepping plate, which are provided with threaded holes.

It is advantageous in this case if the stepping plate, which is preferably manufactured from a plastic material, has threaded sleeves which are manufactured of metal and are held in bores provided in the stepping plate by means of a force fit.

In place of springs, it is possible to provide in the base plate guideways, according to FIGS. 18 to 20, which cause movement of the stepping plate away from its transverse axle during pivotal movement. In this case, of course, friction members would have to be provided which, during the pivotal movement of the stepping plate, prevent relative movement between the braking mandrels and the stepping plate.

The base plate does not necessarily need to be secured to the upper side of the ski. It can be adjustable longitudinally of the ski and releasably securable by means of a guideway secured on the upper side of the ski. This is true for all exemplary embodiments. Furthermore, with minor structural changes, it is possible to use compression springs in place of the tension springs and vice versa.

Also, it may be possible to incorporate various features of certain exemplary embodiments into other exemplary embodiments.

To operate ski brakes, erecting springs are typically used which continuously urge the braking mechanism, including the stepping plate and the braking mandrels, pivotally toward the braking position. These springs are generally torsion springs or leaf springs. Referring to the embodiment of FIGS. 1 to 3, a typical erecting spring 50 which is a torsion spring is shown. Since the structure and arrangement of such springs is conventional and known to the man skilled in the art, erecting springs are not discussed and illustrated for the other exemplary embodiments.

The embodiments of the invention in which an exclusive property or privilege is claimed are defined as follows:

1. In a ski brake mountable on a ski, including: a base plate which is adapted to be secured to the ski; a stepping member supported on said base plate for pivotal movement about a pivot axis between a braking position and a retracted position; erecting means yieldably urging said stepping member toward said braking position; a braking mandrel having a first section which is rotatably supported on and fixed against axial movement with respect to said stepping member and extends approximately radially of said pivot axis, a second section which is radially offset from and extends approximately parallel to said first section, and a third section which connects said first and second sections, rotation of said first section of said braking mandrel effecting movement of said second section thereof between first and second positions which are respectively spaced laterally outwardly and laterally inwardly of a side wall of the ski; and first means for effecting rotation of said first section of said braking mandrel in response to pivotal movement of said stepping member so that said second section of said braking mandrel is respectively in its first and second position when said stepping member is in said braking and retracted positions; the improvement comprising wherein said first means includes: a control part supported on said stepping member for movement axially of said first section of said braking arm between first and second positions; second means for effecting movement of said control part between its first and second positions in response to movement of said stepping member between said braking and retracted positions, respectively; means defining a coarse helical thread on one of said control part and said first section of said braking mandrel; and third means on the other of said control part and first section of said braking mandrel cooperable with said coarse helical thread for effecting rotation of said first section of said braking arm in response to movement of said control part so that said second section of said braking arm is respectively in its first and second positions when said control part is in its first and second positions.

2. The ski brake according to claim 1, wherein said second means includes a spring, and wherein said control part is biased by said spring in a direction toward its first position.

3. The ski brake according to claim 2, wherein said second means includes said control part having on a side thereof which faces said base plate a control portion which is one of a cam and a leading edge; and wherein said second means also includes a control cam which is secured on said base plate and can engage said control portion of said control part to effect movement of said control part to its second position in response to movement of said stepping member to said retracted position.

4. The ski brake according to claim 2, wherein said second means includes a lever pivotally supported near a free end of said stepping member and having thereon a control cam which extends transversely of the ski and which has a sloped surface which can engage a control portion of said control part which is one of a leading edge and a cam.

5. The ski brake according to claim 4, wherein said lever is supported on the underside of said stepping member and, in said retracted position of said stepping member, has an end supported on one of said base plate and the upper side of the ski.

6. The ski brake according to claim 4, wherein said lever is biased by a spring which urges it toward a stop and wherein, in said braking position, said lever extends through a recess provided in said stepping member so that, during a swinging of said stepping member from said braking position to said retracted position by a ski boot, said lever is pivoted into engagement with said control part.

7. The ski brake according to claim 2, wherein said second means includes a pair of pivotally coupled levers, one of said levers being pivotally supported near a free end of said stepping member and the other of said levers being pivotally supported on said control part, a portion of one said lever located near the pivotal coupling between said levers, during swinging of said stepping member toward said retracted position, engaging one of said base plate and the upper side of the ski and moving said control part toward its second position against the urging of said spring.

8. The ski brake according to claim 1, wherein said first section of said braking mandrel is supported in a bearing block provided on said stepping member for limited pivotal movement relative to said stepping member about an axis substantially parallel to said pivot axis, wherein between said bearing block and said control part there is arranged a spring which urges said control part toward its first position, wherein said control part has a transversely extending and flat first control surface which is inclined at an angle with respect to said first section of said braking mandrel and which can engage a second control surface provided on said stepping member, and wherein during a swinging of said stepping member toward said retracted position said two control surfaces engage each other and move said control part, against the force of said spring, toward its second position, thereby causing said second section of said braking mandrel to move to its second position.

9. The ski brake according to claim 8, wherein said control part has a downward projection which can engage one of said base plate and the upper side of the ski.

10. The ski brake according to claim 1, wherein said second means includes a support member supported on said stepping member for movement axially of said first section of said braking mandrel independently of said control part, and includes an approximately arcuate leaf spring having one end engaging said control part and the other end engaging said support member.

11. The ski brake according to claim 10, wherein said first section of said braking mandrel is supported rotatably in said support member but is secured against axial movement relative thereto.

12. The ski brake according to claim 10, wherein said coarse helical thread is provided on said first section of said braking mandrel, and wherein said third means includes a threaded hole provided in said support member, said first section of said braking mandrel extending through said threaded hole, and wherein said threaded hole operatively engages said coarse helical thread on said first section of said braking mandrel.

13. The ski brake according to claim 1, including two said braking mandrels, each having a said first section rotatably supported on said stepping member, said first sections of said braking mandrels being spaced from and generally parallel to each other, and wherein said first means is cooperable with said first section of each of said braking mandrels for effecting rotation thereof in response to movement of said control part.

14. The ski brake according to claim 13, wherein said first section of each said braking mandrel has said helical thread thereon; wherein said third means includes two spaced, threaded openings which are provided through said control part and each receive said first section of a respective said braking mandrel and threadedly cooperate with said helical thread thereon; and wherein said second means includes resilient means for yieldably urging said control part toward its first position.

* * * * *